US007654776B2

(12) United States Patent
MacDonald et al.

(10) Patent No.: US 7,654,776 B2
(45) Date of Patent: Feb. 2, 2010

(54) RETAINING WALL BLOCK

(75) Inventors: Robert A. MacDonald, Plymouth, MN (US); Robert J. Race, Eagan, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 0 days.

(21) Appl. No.: 12/105,064

(22) Filed: Apr. 17, 2008

(65) Prior Publication Data

US 2008/0190057 A1 Aug. 14, 2008

Related U.S. Application Data

(63) Continuation of application No. 11/698,341, filed on Jan. 26, 2007, now Pat. No. 7,448,830, which is a continuation of application No. 09/312,352, filed on May 14, 1999, now Pat. No. 7,168,892.

(30) Foreign Application Priority Data

Oct. 13, 1998 (AU) ..... PP6472

(51) Int. Cl.
*E02D 29/02* (2006.01)

(52) U.S. Cl. ..... 405/284; 405/286

(58) Field of Classification Search ..... 405/262, 405/284, 286

See application file for complete search history.

(56) References Cited

U.S. PATENT DOCUMENTS

| | | | |
|---|---|---|---|
| 2,235,646 | A | 3/1941 | Schaffer |
| 3,036,407 | A | 5/1962 | Dixon |
| 3,430,404 | A | 3/1969 | Muse |
| 3,783,566 | A | 1/1974 | Nielson |
| 3,936,987 | A | 2/1976 | Calvin |
| 4,110,949 | A | 9/1978 | Cambiuzzi et al. |
| 4,454,699 | A | 6/1984 | Strobl |
| 4,914,876 | A | 4/1990 | Forsberg |
| 4,920,712 | A | 5/1990 | Dean, Jr. |
| 4,997,316 | A | 3/1991 | Rose |
| 5,044,834 | A | 9/1991 | Janopaul, Jr. |
| 5,161,918 | A | 11/1992 | Hodel |
| 5,214,898 | A | 6/1993 | Beretta |

(Continued)

OTHER PUBLICATIONS

Apr. 2, 2004 European Search Report for counterpart Application No. EP 99 94 1110 (3 pages).

(Continued)

*Primary Examiner*—William P Neuder
(74) *Attorney, Agent, or Firm*—Popovich, Wiles & O'Connell, P.A.

(57) ABSTRACT

A retaining wall block has parallel top and bottom faces, a front face, a rear face, first and second side wall faces and a vertical plane of symmetry extending between the front and rear faces. The block is formed as a body portion including the front face, a head portion including the rear face and a neck portion connecting the body portion and the head portion. The body, head and neck portions each extend between the top and bottom faces and between the first and second side wall faces. An opening extends through the neck portion from the top face to the bottom face, dividing the neck portion into first and second neck wall members extending rearwardly from the body portion to the head portion.

24 Claims, 8 Drawing Sheets

U.S. PATENT DOCUMENTS

| | | | | | |
|---|---|---|---|---|---|
| RE34,314 | E | | 7/1993 | Forsberg | |
| 5,257,880 | A | * | 11/1993 | Janopaul, Jr. | 405/284 |
| 5,294,216 | A | | 3/1994 | Sievert | |
| 5,560,172 | A | | 10/1996 | Brophy et al. | |
| 5,735,643 | A | * | 4/1998 | Castonguay et al. | 405/286 |
| 5,913,790 | A | | 6/1999 | Dawson | |
| 5,941,042 | A | | 8/1999 | Dueck | |
| 5,951,210 | A | | 9/1999 | Maguire et al. | |
| 6,019,550 | A | | 2/2000 | Wrigley et al. | |
| 6,062,772 | A | | 5/2000 | Perkins | |
| 6,115,983 | A | | 9/2000 | Poignard | |
| 6,622,445 | B1 | | 9/2003 | Shillingburg et al. | |
| 6,821,058 | B1 | | 11/2004 | Dawson | |
| 7,011,474 | B2 | | 3/2006 | MacDonald | |
| 7,168,892 | B1 | | 1/2007 | MacDonald et al. | |
| 7,360,970 | B2 | | 4/2008 | Woolford et al. | |

OTHER PUBLICATIONS

Oct. 29, 1999 PCT Notification of Transmittal of the International Search Report for PCT/US99/18416 (5 pages).

* cited by examiner

RETAINING WALL BLOCK

This application is a continuation of application Ser. No. 11/698,341, filed Jan. 26, 2007, which is a continuation of application Ser. No. 09/312,352, filed May 14, 1999, now U.S. Pat. No. 7,168,892 B1, the contents of each of which are hereby incorporated herein by reference.

FIELD OF THE INVENTION

The present invention is directed to the field of retaining walls and blocks used to construct a retaining wall.

BACKGROUND TO THE INVENTION

Numerous methods and materials exist for the construction of retaining walls. Such methods include the use of natural stone, poured in place concrete, masonry, and landscape timbers or railroad ties. In recent years, segmental concrete retaining wall units which are dry stacked (i.e., built without the use of mortar) have become a widely accepted product for the construction of retaining walls. Examples of such products are described in U.S. Pat. No. Re. 34,314 (Forsberg '314) and U.S. Pat. No. 5,294,216 (Sievert). Such products have gained popularity because they are mass produced, and thus relatively inexpensive. They are structurally sound, easy and relatively inexpensive to install, and couple the durability of concrete with the attractiveness of various architectural finishes.

The retaining wall system described in Forsberg '314 has been particularly successful because of its use of block design that includes, among other design elements, a unique pinning system that interlocks and aligns the retaining wall units, allowing structural strength and efficient rates of installation. This system has also shown considerable advantages in the construction of larger walls when combined with the use of geogrid tie-backs hooked over the pins, as described in U.S. Pat. No. 4,914,876 (Forsberg).

The construction of modular concrete retaining walls as described in Forsberg involves several relatively simple steps. First, a leveling pad of dense base material or unreinforced concrete is placed, compacted and leveled. Second, the initial course of blocks is placed and leveled. Two pins are placed in each block into the pin holes. Third, core fill material, such as crushed rock, is placed in the cores of the blocks and spaces between the blocks to encourage drainage and add mass to the wall structure. Fourth, succeeding courses of the blocks are placed in a "running bond" pattern such that each block is placed between the two blocks below it. This is done by placing the blocks so that the receiving cavities of the bottom of the block fit over the pins that have been placed in the units in the course below. As each course is placed, pins are placed in the blocks, the blocks are corefilled with drainage rock, and the area behind the course is backfilled and compacted until the wall reaches the desired height.

If wall height or loading conditions require it, the wall structure may be constructed using reinforced earth techniques such as geogrid reinforcement, geosynthetic reinforcement, or the use of inextensible materials such as steel matrices. The use of geogrids are described in U.S. Pat. No. 4,914,876 (Forsberg). After placement of a course of blocks to the desired height, the geogrid material is placed so that the pins in the block penetrate the apertures of the geogrid. The geogrid is then laid back into the area behind the wall and put under tension by pulling back and staking the geogrid. Backfill is placed and compacted over the geogrid, and the construction sequence continues as described above until another layer of geogrid is called for in the planned design. The use of core fill in the blocks is known to enhance the wall system's resistance to pull out of the geogrid from the wall blocks when placed under pressure.

Existing segmental wall block designs have proven quite versatile, but have limitations in constructing certain structures. A common design detail for retaining wall structures is to include a fence or guardrail at the top of the retaining wall. Many segmental wall designs are not able to accommodate the anchoring posts for such structures. Similarly, it is not always feasible to extend geosynthetic reinforcement behind a wall. This may occur due to the presence of a structure or a property line immediately behind the wall. Most existing modular walls blocks cannot be constructed through the use of grout and rebar reinforcement.

There is a need for a retaining wall block that improves on the Forsberg design. Since the blocks are usually placed through manual labor, it would be desirable to decrease the weight of the Forsberg design without compromising the performance characteristics of the block. Because the placement of corefill is an important factor influencing wall construction efficiency, it would be desirable to improve the ease with which core fill may be placed. It would also be desirable to improve the Forsberg blocks' ability to resist pull out of geosynthetic reinforcement placed between courses of the blocks. It would also be desirable to have a wall block design that would allow construction of such common construction details as the placement of guardrail posts or fence posts at the top of the wall, or the provision of pilasters for aesthetic or other purposes. It would also be desirable to provide a block that would allow the wall to be reinforced with rebar and concrete grout rather than soil reinforcement.

SUMMARY OF THE INVENTION

It is an object of the present invention to provide an improved retaining wall block satisfying at least one of the above desires.

In one aspect the present invention is a retaining wall block having parallel top and bottom faces, a front face, a rear face, first and second side wall faces and a vertical plane of symmetry extending between the front and rear faces, the block comprising a body portion including the front face, a head portion including the rear face, a neck portion connecting the body portion and the head portion, the body, head and neck portions each extending between the top and bottom faces and between the first and second side wall faces, an opening extending through the neck portion from the top face to the bottom face, the opening dividing the neck portion into first and second neck wall members extending rearwardly from the body portion to the head portion, first and second pin holes each disposed in the body portion and opening onto the top face for receiving a pin with a free end of the pin protruding beyond the top face, first and second pin receiving cavities each disposed in the body portion and opening onto the bottom face for receiving the free end of a pin received in a pin hole of an adjacent block disposed therebeneath so as to interlock the blocks with a predetermined setback, wherein the neck wall members, the pin holes and the pin receiving cavities are positioned such that a first plane extending parallel to the plane of symmetry passes through the first pin receiving cavity, the first pin hole and the first neck wall member and a second plane extending parallel to the plane of symmetry passes through the second pin receiving cavity, the second pin hole and the second neck wall member.

Typically the first and second neck wall members are each positioned so as to substantially vertically align, in use, with a the neck wall member of a vertically adjacent block in an adjacent courses of a wall made from a plurality of courses of the blocks laid in a running bond pattern.

Typically the first and second planes are located approximately midway between the plane of symmetry and laterally outermost points of the first and second the wall faces, respectively.

Preferably the first and second pin receiving cavities each have a rear wall extending generally perpendicularly to the plane of symmetry.

Preferably the block further comprises third and fourth pin holes each disposed in the body portion and opening onto the top face for receiving a pin with a free end of the pin protruding beyond the top face, the third and fourth pin holes being disposed on the first and second planes forward of the first and second pin holes so as to provide a reduced or zero predetermined setback.

Preferably the side wall faces generally taper from the front face to the rear face.

Preferably the head portion has first and second ears extending laterally beyond the first and second neck wall members, respectively, the first and second ears each being provided with a notch to enable the ears to be knocked off the head portion.

The present invention further provides a retaining wall formed of a plurality of courses of the blocks laid in a running bond pattern, blocks of a given course each having a pair of pins each projecting beyond the top surface of the block and engaging the pin receiving cavity of a vertically adjacent block in the next lowermost course, a continuous cavity being defined by each the opening of vertically aligned blocks in every second course of the blocks communicating with side voids of vertically adjacent blocks in each alternate course, the side voids of a block being defined between the head and body portions either side of the neck portion of the block.

The retaining wall may be a straight wall, a curved wall or a serpentine wall.

The retaining wall may be reinforced with rebar and grouting, a length of the rebar passing through each of at least one of the cavities, each length of the rebar being secured in the respective cavity with grout.

The retaining wall may incorporate at least one post each extending into a the continuous cavity and protruding from the top course, each of the at least one post being secured in the respective cavity with grout.

The retaining wall may incorporate a geogrid tie-back disposed between two adjacent the courses, the geogrid tie-back being secured with the pins passing through apertures thereof.

The retaining wall may incorporate a pilaster formed of a column of the blocks set forward from the remainder of the wall.

BRIEF DESCRIPTION OF THE DRAWINGS

A preferred form of the present invention will now be described by way of example with reference to the accompanying drawings, wherein.

DETAILED DESCRIPTION OF PREFERRED EMBODIMENTS

Figure 1:
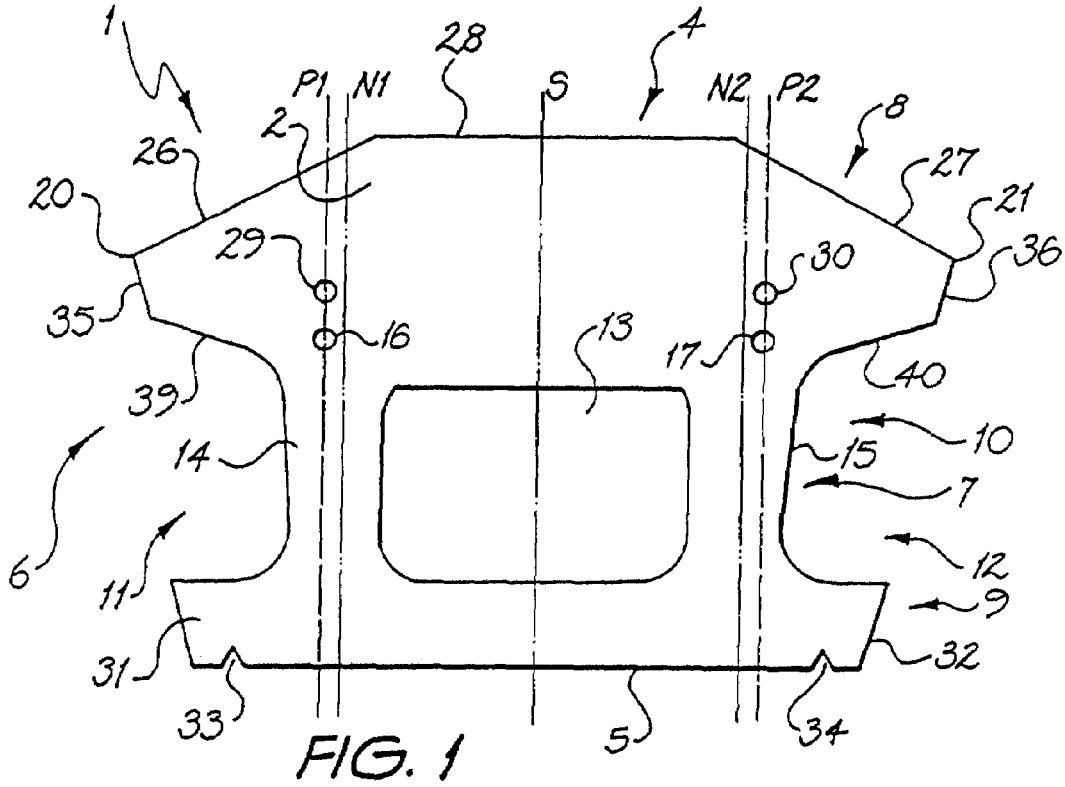
FIG. 1 is a plan view of a retaining wall block.
Figure 2:
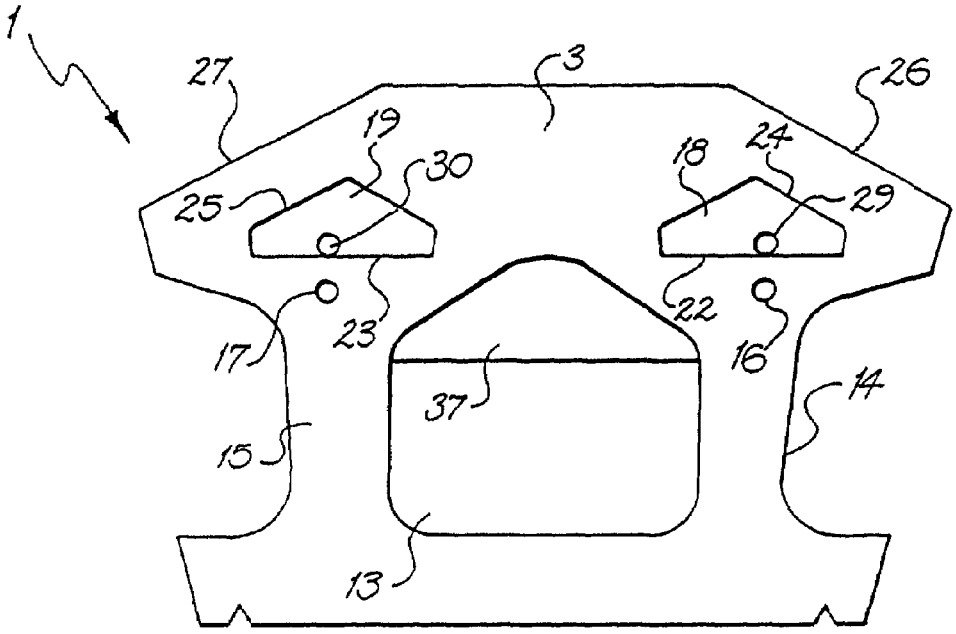
FIG. 2 is an inverse plan view of the retaining wall block of FIG. 1.
Figure 3:
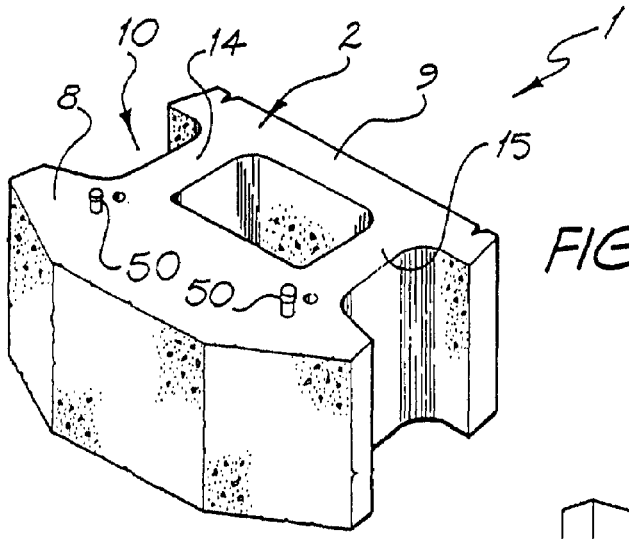
FIG. 3 is an isometric view from above and in front of the retaining wall block of FIG. 1.
Figure 4:
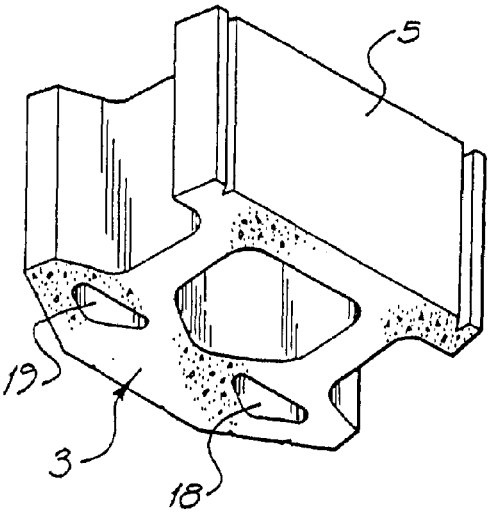
FIG. 4 is an isometric view from below and behind of the retaining wall block of FIG. 1.

Referring to FIGS. 1 to 4 there is shown retaining wall block 1 according to a preferred embodiment of the present invention. Block 1 is made of a rugged, weather resistant material, preferably pre-cast concrete. Other suitable materials are plastic, reinforced fibers, wood, metal and stone. Block 1 has parallel top face 2 and bottom face 3, front face 4, rear face 5 and first and second side wall faces 6 and 7. Front face 4 and rear face 5 each extend from top face 2 to bottom face 3 and side wall faces 6, 7 extend from top face 2 to bottom face 3 and from front face 4 to rear face 4. Block 1 is generally symmetrical about vertical plane of symmetry S.

The integrally formed block 1 takes the form of body portion 8, head portion 9 and neck portion 10 connecting body portion 8 and head portion 9. Front face 4 forms part of body portion 8, while rear face 5 forms part of head portion 9. The body, head and neck portions 8, 9, and 10 each extend between top and bottom faces 2 and 3 and between first and second side wall faces 6, 7. Side wall faces 6 and 7 are thus of a compound shape and define side voids 11 and 12 between body and head portions 8 and 9 either side of neck portion 10 as a result of the reduced width of neck portion 10 compared to that of body and head portions 8 and 9.

Opening 13 extends through neck portion 10 from top face 2 to bottom face 3. Opening 13 divides neck portion 10 into first and second neck wall members 14 and 15 which extend rearwardly from body portion 8 to head portion 9. Opening 13 and side voids 11 and 12 reduce the weight of block 1, facilitating handling thereof.

Figure 6:
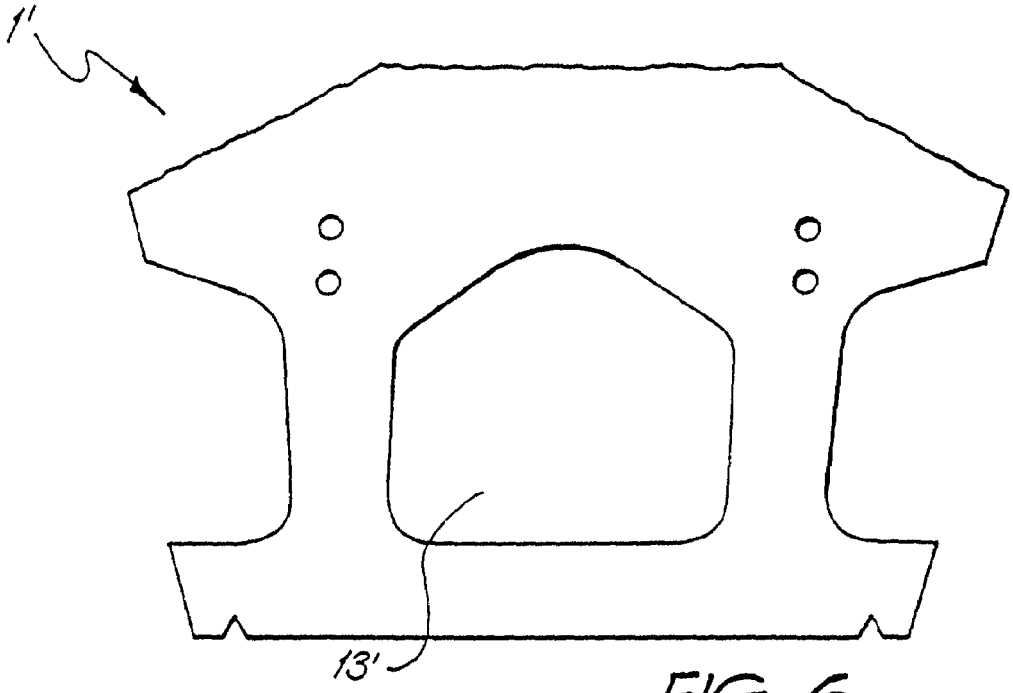
FIG. 6 is a plan view of an alternative retaining wall block.
Figure 7:
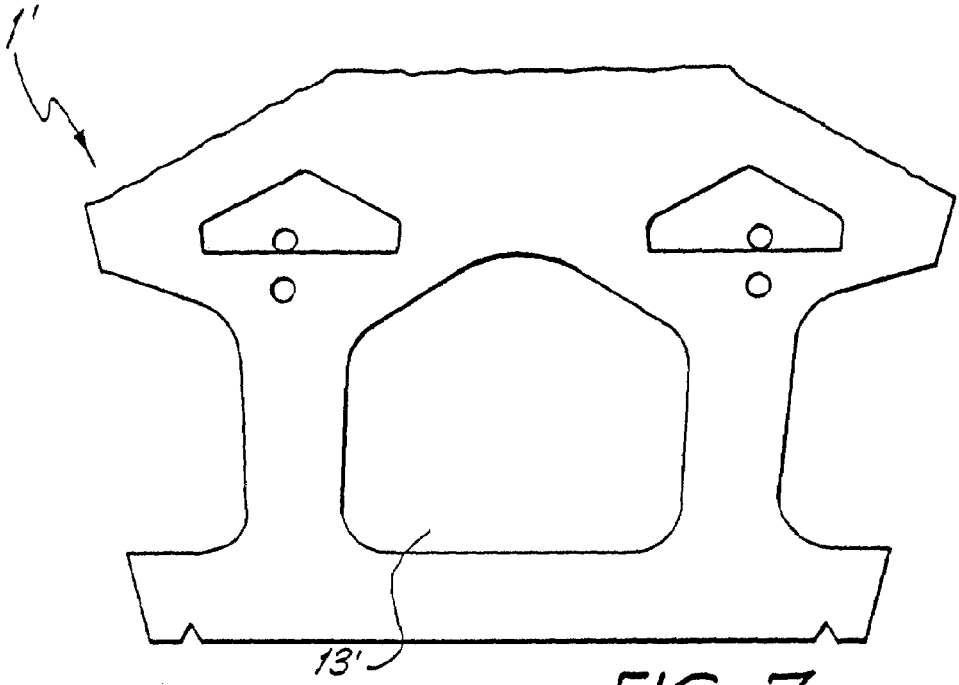
FIG. 7 is an inverse plan view of the alternative retaining wall block of FIG. 6.

The opening may be provided with ledge 37 toward top face 2 covering the forward portion of opening 13, however ledge 37 is dispensed with in an alternate embodiment of the block 1' depicted in FIGS. 6 and 7, leaving the opening 13' of constant cross section throughout its depth from the top face 2' to the bottom face 3', further reducing the weight of the block 1'.

First and second pin holes 16 and 17 are disposed in body portion 8 and open onto top face 2. Pin holes 16 and 17 are sized to receive pins 50 and 51 (discussed below) with a free end of the pin protruding beyond top face 2. Pin holes 16 and 17 will also typically extend through to bottom face 3 as a result of the preferred method of manufacture discussed below. First and second pin receiving cavities 18 and 19 are disposed in body portion 8 and open onto bottom face 3. Pin receiving cavities 18 and 19 receive the free ends of pins protruding from pin holes of vertically adjacent blocks disposed therebeneath in the next uppermost course so as to interlock the blocks with a predetermined setback in the same general manner as that described in the earlier Forsberg patent, U.S. Pat. No. Re. 34,134. First and second pin holes 16 and 17 (or more preferably additional third and fourth pin holes 29 and 30 discussed below) may be positioned such that the predetermined setback is zero.

Neck wall members 14 and 15, pin holes 16 and 17 and pin receiving cavities 18 and 19 are positioned such that a first plane P1 extending parallel to plane of symmetry S passes through first pin receiving cavity 18, first pin hole 16 and first neck wall member 14 and such that second plane P2 extending parallel to plane of symmetry S passes through second pin receiving cavity 19, second pin hole 17 and second neck wall member 15.

Figure 5:
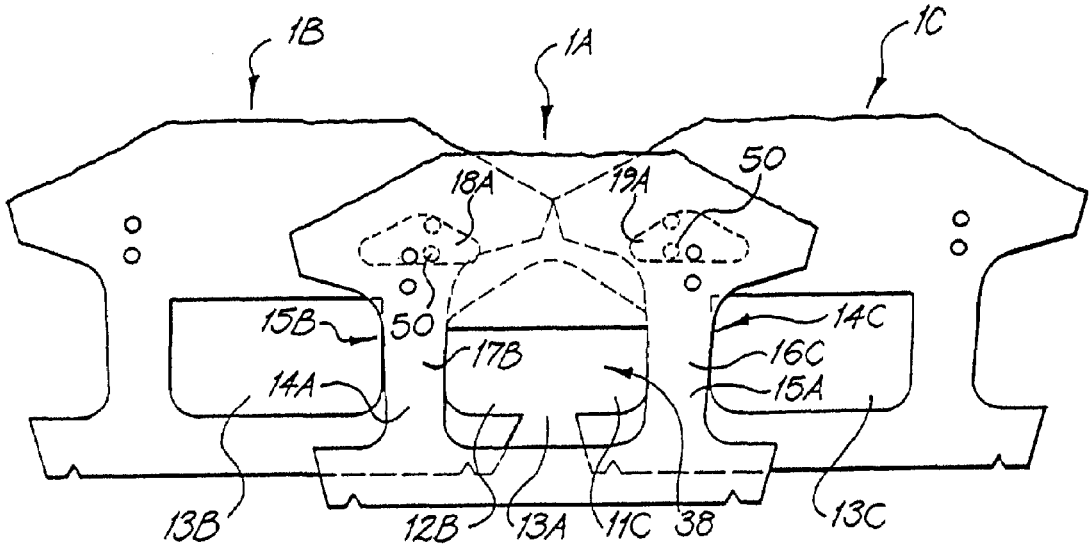
FIG. 5 is a plan view of a three interlocked retaining wall blocks.

The effect of this configuration is best described with reference to FIG. 5 which depicts first block 1A interlocked with second and third blocks 1B, 1C disposed beneath block 1A and laid in a running bond pattern with first block 1A set back from second and third blocks 1B, 1C. Pins 50 are received in second pin receiving hole 17B of the second block 1B and first pin receiving hole 16C of third block 1C and respectively engage first and second pin receiving cavities 18A and 19A of first block 1A so as to provide the interlock between the blocks with the predetermined setback. As can be seen, the configuration ensures that the neck wall members of adjacent blocks overlap. First neck wall member 14A of first block 1A overlaps second neck wall member 15B of second block 1B, while second neck wall member 15B of first block 1A overlaps first neck wall member 14C of third block 1C. This overlap provides continuity of structure in the neck region between courses of blocks enabling transfer of compressive loads in this area through successive courses of blocks, minimizing the bridging of unsupported areas. Structural integrity of the wall can hence be achieved with a lighter mass block with increased opening 13 and void areas 11 and 12, as an increased proportion of the material of the block is able to transfer load between blocks.

The configuration also provides overlap between opening 13A of first block 1A and side voids 12B, 11C of second and third blocks 1B, 1C, as well as between the side voids of first block 1A and openings 13B and 13C of second and third blocks 1B, 1C. This overlap provide continuous cavities 38 in the wall which extends through successive courses of blocks, improving the ease with which the cavities can be filled with core fill material such as crushed rock to encourage drainage and add stabilizing mass to the wall or alternatively easing placement of grout. Continuous cavities 38 also allow for the placement of guardrail posts or fences at the top of a wall as described below, or for the reinforcement of the wall with rebar and concrete grout as is also discussed below.

Beyond merely overlapping, it is preferred that first and second neck wall members 14 and 15 are positioned so that they will substantially vertically align with the neck wall members of blocks in adjacent courses when laid in a running bond pattern, as is the case with the current preferred embodiment. Such vertical alignment maximizes the resistance of the blocks against crushing when used in extremely tall walls. This will best be achieved if first and second planes P1 and P2 run along or close to planes N1 and N2 running generally centrally though first and second neck wall members 14 and 15, respectively. To provide such vertical alignment and to ensure blocks disposed side by side in a given course of blocks are closely adjacent without any significant gap between them, first and second planes P1 and P2 will typically be located approximately midway between plane of symmetry S and laterally outermost points 20 and 21 of first and second side wall faces 6 and 7, respectively.

In the depicted preferred embodiment, as best seen from FIG. 1, plane N1, N2 running generally centrally through each of neck wall members 14, 15 lies midway between plane of symmetry S and laterally outermost points 20 and 21, while first and second planes P1 and P2 lie slightly outboard of planes N1 and N2, a distance equal to 1.5-2% of the overall width of the block. This can also be seen in FIG. 5 where the central planes (not marked) of the overlapping neck wall members align, resulting in the pin holes of adjacent blocks being slightly offset. The neck wall members need not extend parallel to plane of symmetry S so as to provide symmetry about planes N1 and N2, so long as planes P1 and P2 extend along the length of the neck wall members 14 and 15 so as to provide continuous support between vertically adjacent blocks.

First and second pin receiving cavities 18 and 19 each have rear wall 22 and 23, respectively, which extends generally perpendicularly to plane of symmetry S, allowing for some forgiveness in the positioning of blocks with respect to vertically adjacent blocks, allowing the blocks to move slightly out of the bond pattern as a result of corners or curves. Here pin receiving cavity rear walls 22 and 23 are approximately 100 mm (4 inches) long. When first block 1A of FIG. 5 is placed with its pin receiving cavities 18A and 19A over pins 50 protruding from pin holes 17B and 16C of second and third blocks 1B and 1C, first block 1A is manually pushed forward until pins 50 engage pin receiving cavity rear walls 22 and 23, thus interlocking the blocks. The generally triangular shape of the pin receiving cavities allows minor lateral adjustments of the blocks while maximizing the distance between the front edge of the cavity and the front face of the blocks which reduces the possibility of face cracks. The interlocked position defines the set-back between courses of blocks, and is equal to the distance between the pin receiving cavity rear walls 22 and 23 and the rear edge of pin receiving holes 16 and 17, assuming a constant cross-section pin 50 is employed. This setback distance can thus be predetermined through the design of the block, and will typically be of the order of 25 mm (1 inch) for a block such as that depicted which has a height of 200 mm (7.9 inches), providing for a setback of approximately 12.5% or 1:8. For given situations however, it may be desired to design the block for a larger setback, a reduced setback or a zero setback.

Pin receiving cavities 18 and 19 are here approximately 30 mm deep for reception of a pin free end, which will typically project from top face 4 of the underlying block by approximately 20 mm. The outer front walls 24, 25 of the triangular shaped pin receiving cavities 18 and 19 lie generally parallel to the outer rearwardly angled surfaces 26 and 27 of front face 4, and spaced approximately 38 mm (1.5 inches) therefrom so as to reduce the possibility of face cracking when forming the rough front face 4 with the conventional face splitting technique.

The front face is formed of angled outer surfaces 26 and 27 and central surface 28 disposed perpendicular to plane of symmetry S so as to provide for a multi-faceted front face on a wall constructed of the blocks. Alternatively, a variety of front face designs may be used.

Referring to FIGS. 1 to 4, the preferred block has a pair of third and fourth pin holes 29 and 30 disposed forwardly of first and second pin holes 16 and 17 to provide a reduced setback as compared to that provided by first and second pin holes 16 and 17. Here that reduced setback is a zero setback when used with constant cross-section pins 50. Third and fourth pin holes 29 and 30 are each disposed in body portion 8 and open onto top face 2 for receiving pin 50 with a free end thereof protruding beyond top face 2 in a similar manner to first and second pin holes 16 and 17. Third and fourth pin holes 29 and 30 are again disposed on first and second planes P1 and P2, each with their rear edge aligned with the corresponding pin receiving cavity rear wall 22 and 23 so as to provide zero setback when used with constant cross-section pins 50. Further pin holes can be provided, if desired, so as to provide for further choices of predetermined setback.

Figure 8:
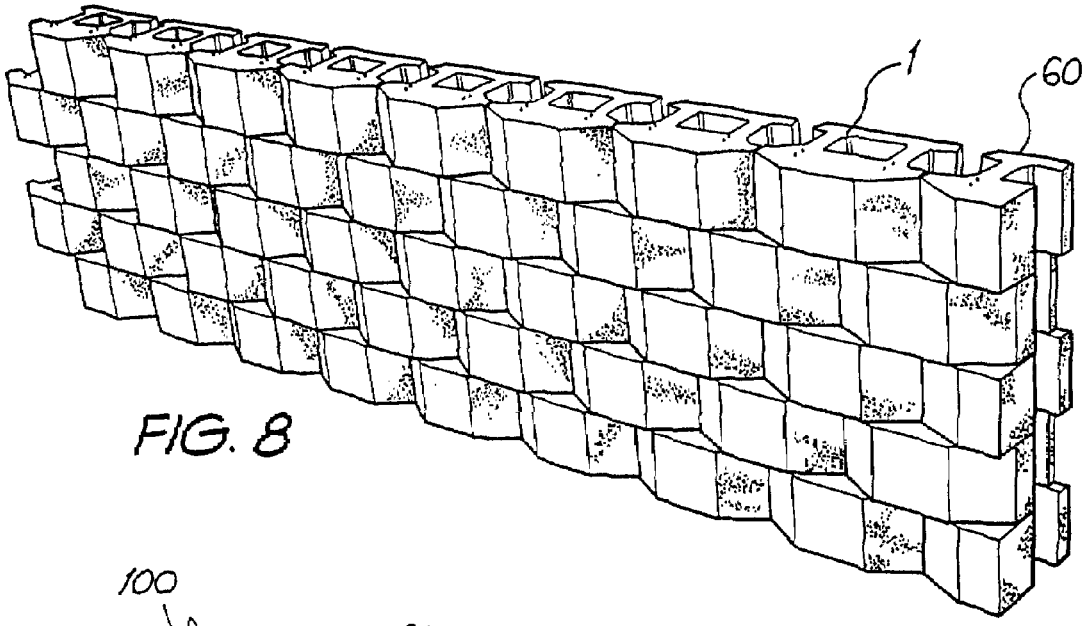
FIG. 8 is a perspective view of a retaining wall built of the retaining wall block of FIG. 1.
Figure 9:
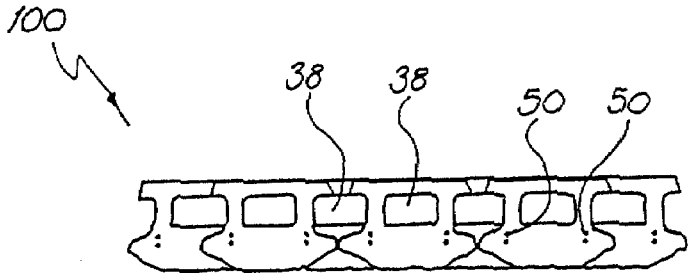
FIG. 9 is a plan view of a section of the retaining wall of FIG. 8.

Straight retaining wall 100 constructed from the blocks utilizing third and fourth pin holes 29 and 30 to interlock the blocks is depicted in FIGS. 8 and 9. As can be seen, use of third and fourth pin holes 29 and 30, with a constant cross-section pin 50, provides zero or near vertical setback between courses resulting in a vertical wall 100. Half blocks 60 may be used at the lateral ends of wall 100 in alternate courses to finish the wall in the usual manner if the wall end abuts a vertical surface. Half blocks may be field cut using a masonry saw or cut at the factory. FIG. 9 clearly depicts how alignment of the neck wall members of vertically adjacent blocks and consequent alignment of neck openings 13 with side voids 11 and 12 of vertically adjacent blocks provides continuous cavities 38 extending through the height of wall 100. Gapping blocks are typically used to finish the top of the wall.

Figure 10:
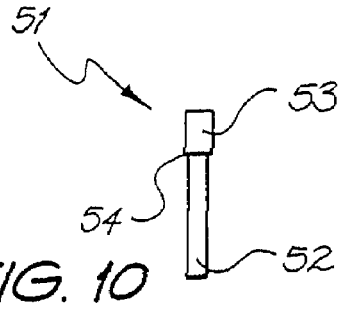
FIG. 10 is a front elevation view of a pin for use with a retaining wall block.

Rather than using a constant-cross section pin 50, an alternate and preferred collared pin 51, as depicted in FIG. 10, has been developed for use with current block 1. Lower section 52 of pin 51 is sized to fit into any of pin holes 16 and 17, 29 or 30, here having a diameter of 12.7 mm (0.5 inches). Upper section 53 is of greater cross section than lower section 52 (and the pin holes), here having a diameter of 18 mm (0.72 inches) so as to form collar 54 at the intersection between upper and lower sections 52, 53. In use, lower section 52 of pin 51 is received in pin hole 16,17, 29 or 30, with collar 54 engaging top face 4 of block 1 preventing pin 51 from falling through the pin hole and ensuring upper section 53 forms a free end protruding a fixed amount (here 20 mm) from the pin hole for engaging a pin receiving cavity of an adjacent block laid in the next course. Pin 51 hence need not extend through the entire length of the pin holes to rest on the block beneath or be jammed into the pin hole with an interference fit to hold it in position.

As well as ensuring the location of pin 51 in the pin hole, the increased diameter upper section 53 increases the setback between adjacent interlocked blocks by the width of the collar, here being approximately 2.6 mm. Use of collared pin 51 in third and fourth pin holes 29 and 30 will hence provide a minimal setback between courses of about 2.6 mm (or 1.3% for the current block) rather than zero setback as will be provided with a constant cross-section pin 50. A wall constructed in this way will still appear essentially vertical but will have increased stability owing to the setback, albeit only a minor setback. The collared pin design and the relative position of the pin holes with respect to the pin receiving cavities can be adjusted in the design to provide near vertical walls or other desired setbacks.

Figure 11:
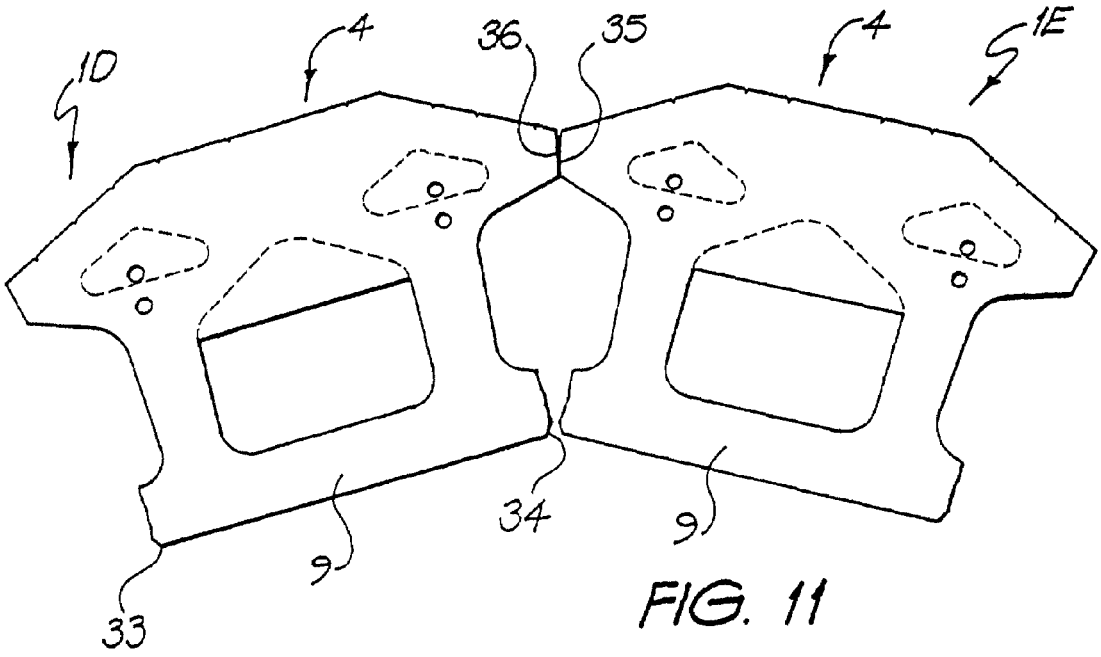
FIG. 11 is a plan view of two retaining wall blocks laid in a tight convex curve.
Figure 12:
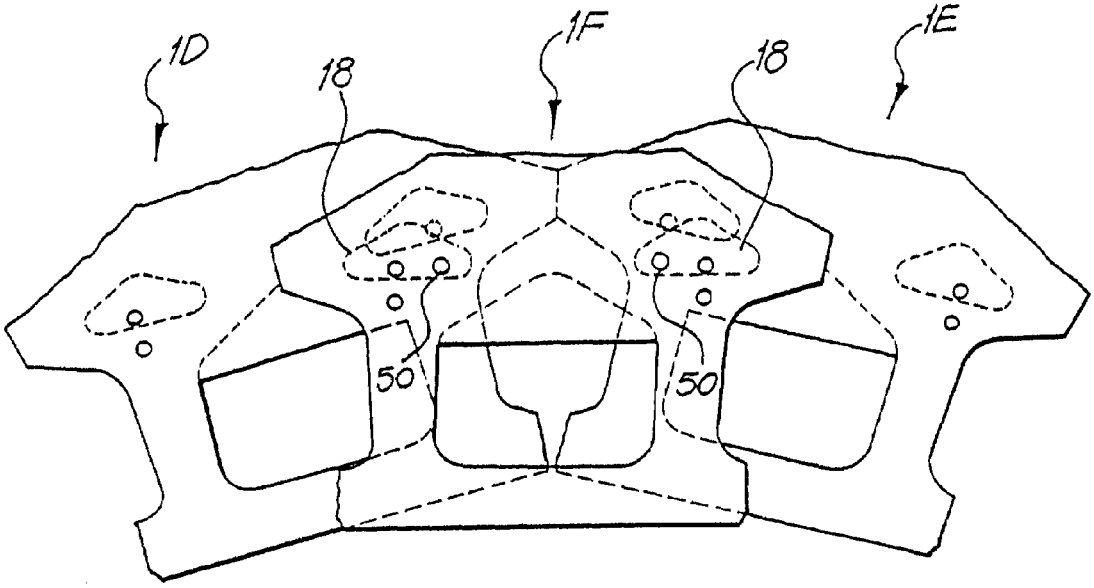
FIG. 12 is a plan view of the retaining wall blocks of FIG. 11 with a third block interlocked therewith.

Block 1 of the preferred embodiment is suitable for forming straight, curved or serpentine walls. To provide for convex faced curved walls and serpentine walls, side wall faces 6 and 7 generally taper from front face 4 to rear face 5, such that the block is wider at front face 4 between outermost points 20 and 21 than at rear face 5. This enables the blocks to be placed in a convex curve in the usual manner without interference between the head portion 9 of laterally adjacent blocks. To provide for increased curvature of a convex-curved section of wall, head portion 9 is provided with first and second ears 31 and 32 extending laterally beyond first and second neck wall members 14 and 15, respectively. First and second ears 31 and 32 can be knocked off head portion 9 with a bolster or similar as a result of the notches 33 and 34 forming weak points in rear face 5 at ears 31 and 32. FIG. 11 depicts two blocks 1D and 1E of a course with ears 31 and 32 bolstered off and laid in a tight convex curve. FIG. 11 also shows that body side wall surfaces 35 and 36 are tapered at an angle sufficient to make full use of the reduced width of head portion 9 when ears 31 and 32 have been bolstered off without creating any gaps between front faces 4 of laterally adjacent blocks. FIG. 12 depicts how third block 1F laid in the next setback course interlocks with first two blocks 1D and 1E. The tight convex curve results in pins 50 protruding from the first and second pin holes of lower blocks 1D and 1E engage rear walls 22F and 23F of pin receiving cavities 18F and 19F toward the inner ends thereof. When forming a concave curve, the pins would engage rear walls 22F and 23F of pin receiving cavities 18F and 19F toward the outer ends thereof.

Figure 13:
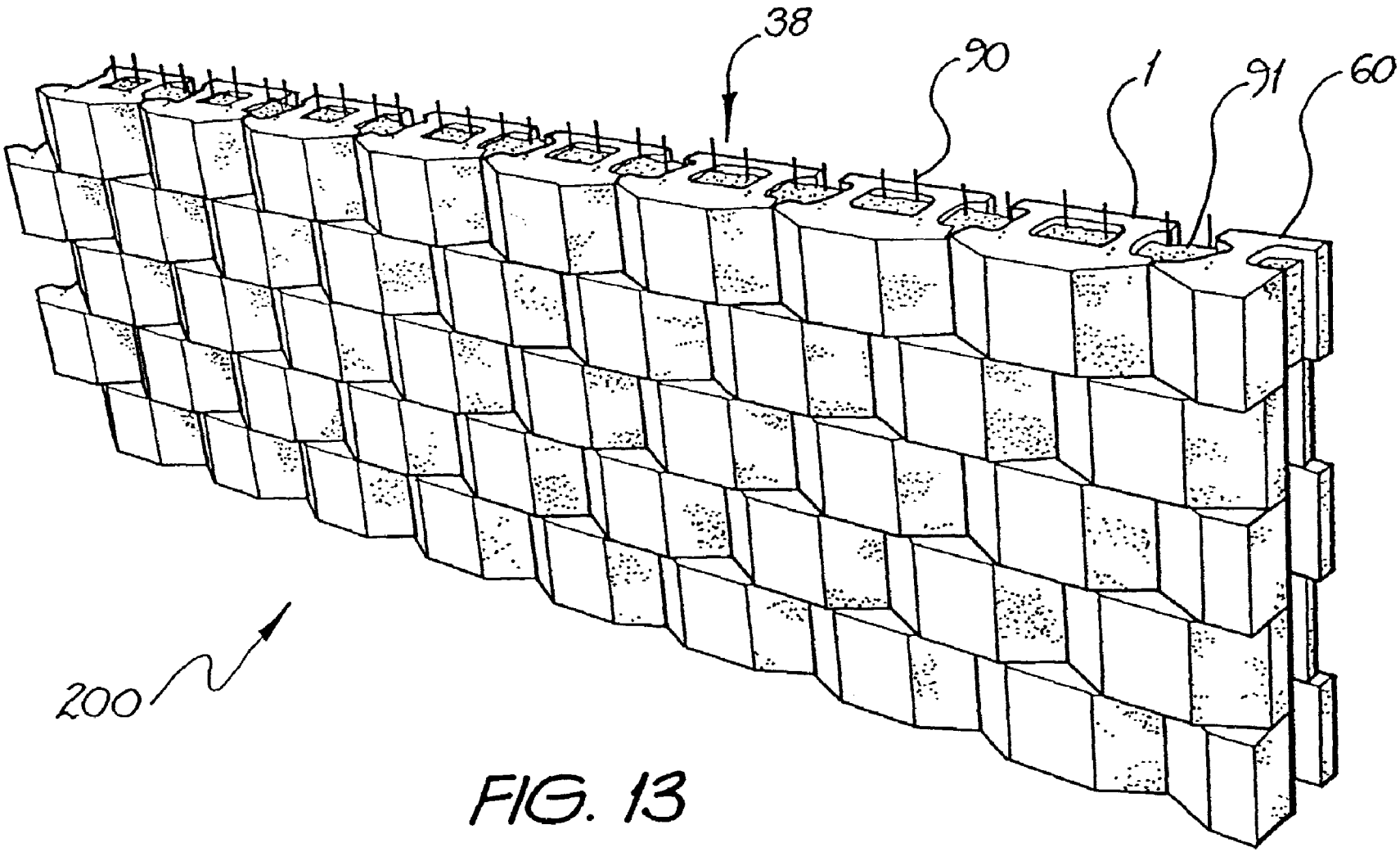
FIG. 13 is a perspective view of a retaining wall similar to that of FIG. 8 but reinforced with rebar and grout.

A retaining wall formed of courses of blocks of the preferred embodiment can be reinforced with the use of rebar and grout. An example of such reinforced wall 200 is depicted in FIG. 13. Lengths of rebar 90 are inserted into at least one of the continuous cavities 38 defined by neck openings 13 and vertically adjacent side voids 11 and 12 of blocks in alternate courses. Cavities 38 are then filled with grout 91 to encase rebar 90. This form of reinforcing is particularly applicable to vertical or minimum setback walls with blocks interlocked using third and fourth pin holes 29 and 30, but can also be used for larger setback walls, where cavities 38 defined in the wall will still be continuous but will be inclined at an angle equal to the setback angle of the wall. Alternatively, the wall may be reinforced by placing threaded rods through the cavities and using conventional post-tension techniques.

Figure 14:
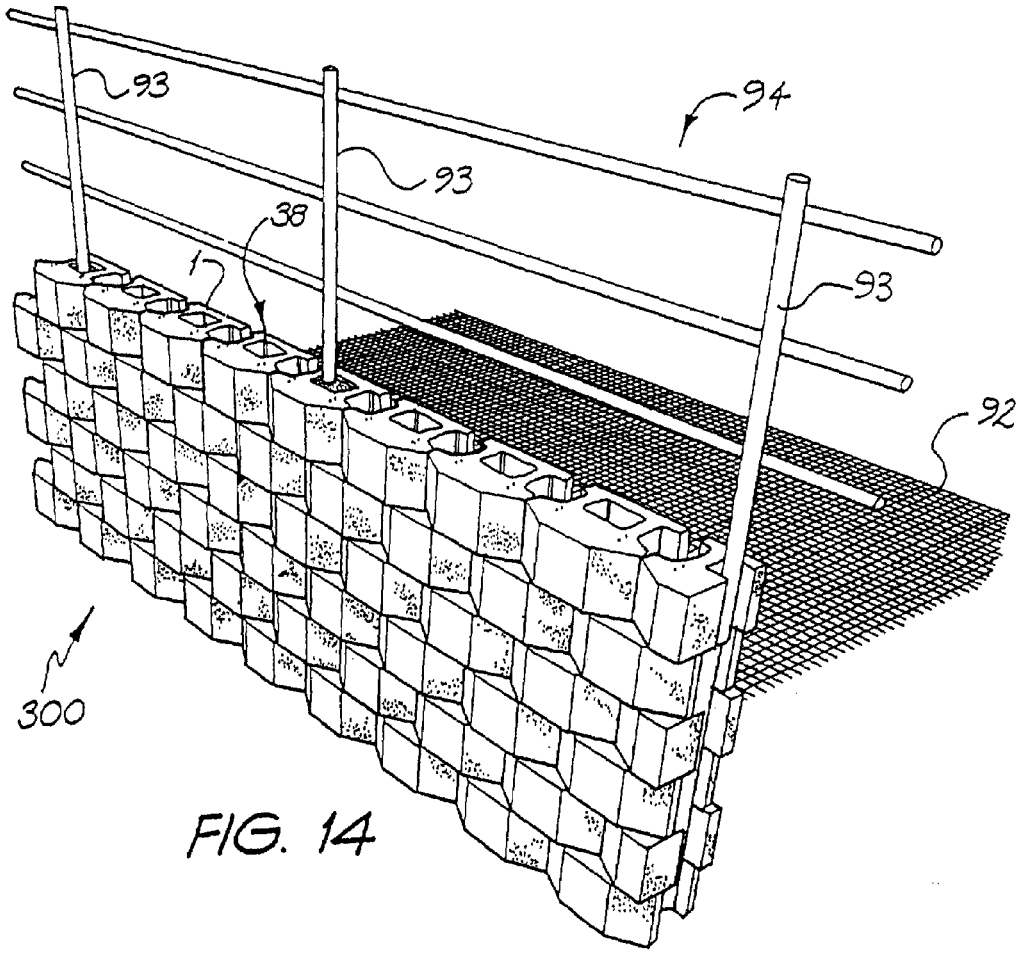
FIG. 14 is a perspective view of a retaining wall similar to that of FIG. 8 but incorporating a geogrid tie-back and fence posts.

The retaining wall can alternatively be reinforced with the use of a reinforcing geogrid tie-back in a similar manner to that disclosed in Forsberg, U.S. Pat. No. Re. 34,134. Vertical retaining wall 300 depicting the use of such a tie-back 92 is shown in FIG. 14. Tie-back 92 is a generally flat sheet of material arranged as a grid, typically formed of high strength plastics material or steel, which is placed between courses of blocks 1 in the retaining wall and extends rearwardly into the fill behind wall 300 to anchor the wall against forces tending to topple the wall forward. Pins 50 interlocking the blocks of adjacent courses are passed through apertures of tie-back grid 92 so as to assist fixing of tie-back 92 between the courses. The configuration of the preferred block which ensures neck wall members 14 and 15 of interlocked blocks overlap in line with pins 50 helps resist pull-out of the tie-back reinforcement 92.

Figure 15:
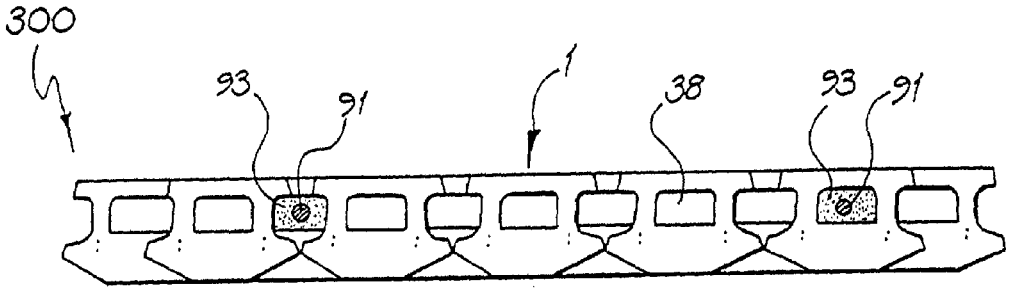
FIG. 15 is a plan view of a section of the retaining wall of FIG. 14.

FIGS. 14 and 15 also depict the integration of fence posts 93 into the top of retaining wall 300. Posts 93 of fence 94, or of similar structures such as guardrails, can be inserted into cavities 38 formed by neck openings 13 and side voids 11 and 12 of the blocks of alternate courses and secured if necessary with grout 91 or other fill. A single sign post could also be secured to the wall in such a manner. Due to the relatively short embedment depth of the preferred embodiment, reinforcement of the structure is typically necessary when placing fence posts 93 in cavities 38. FIGS. 14 and 15 depict geogrid reinforcement for this purpose.

Figure 16:
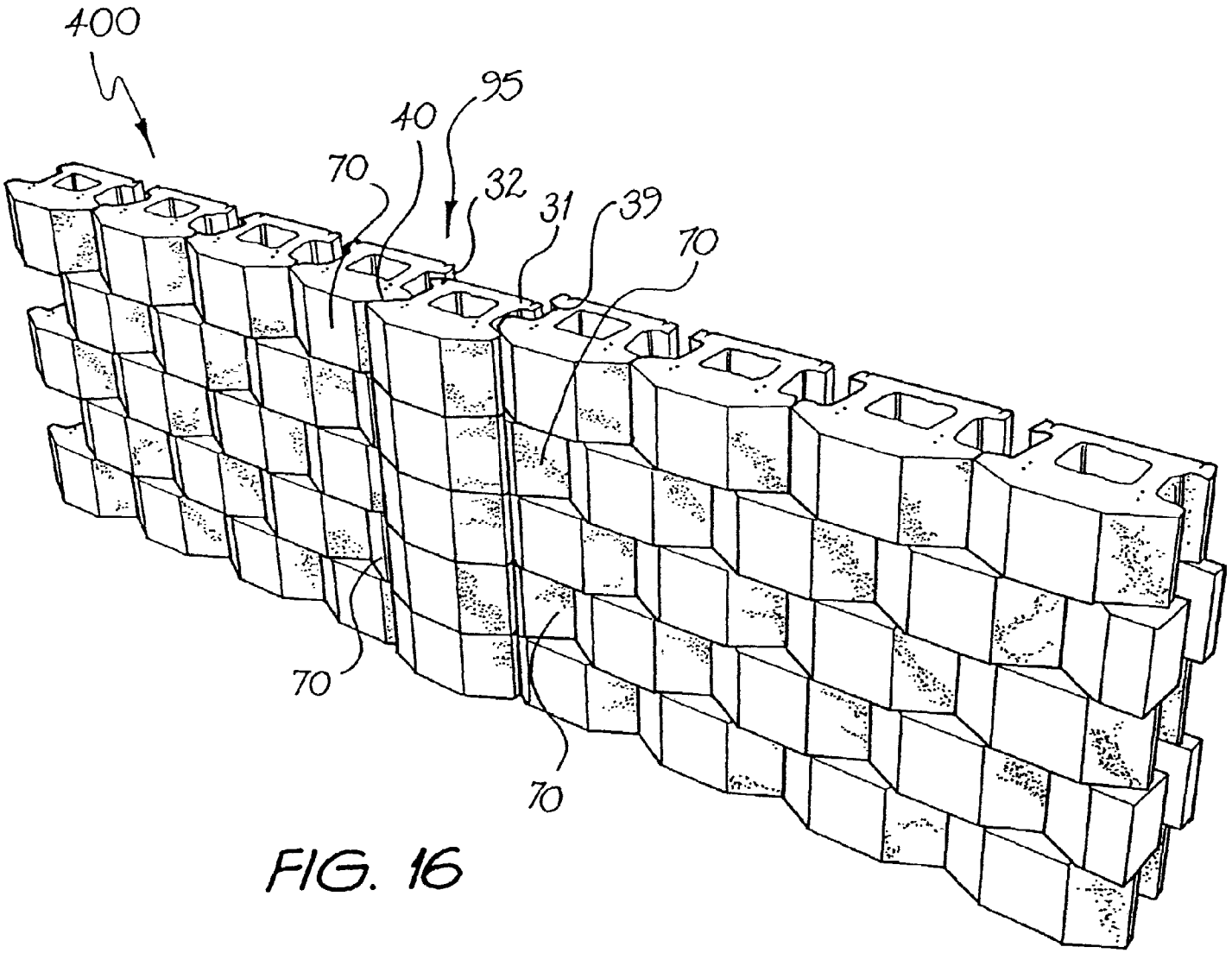
FIG. 16 is a perspective view of a retaining wall similar to that of FIG. 8 but incorporating a pilaster.

The shape of preferred block 1 incorporating head, neck and body portions 9, 7 and 8 also enables the construction of a retaining wall incorporating pilasters for aesthetic or other purposes. FIG. 16 depicts such retaining wall 400 incorporating pilaster 95 formed of a vertical column of blocks 1 set forward from the remainder of vertical retaining wall 400. In every second course (here the bottom, middle and top courses) ears 31 and 32 of the blocks of the pilaster 95 are disposed in side voids 11 and 12 of the laterally adjacent blocks. Preferably, shoulders 39 and 40 of body portion 8 of these blocks engage the outer side surfaces 26 and 27 of front face 4 of the laterally adjacent blocks. In the alternate courses it is preferable to provide truncated blocks 70 laterally adjacent to the pilaster blocks, these truncated blocks being used to fill the gaps which would otherwise be formed in the front face of the wall. The truncated blocks can be formed by cutting half blocks 60 to reduce their width as required. The blocks of pilaster 95 are interlocked in vertical alignment with pins in third and fourth pin holes 29 and 30 of a given block engaging first and second pin receiving cavities 28 and 19 respectively of the block immediately above. Alternatively, if constant cross-section pins or rods (which would extend through multiple blocks) are used, it would be possible to interlock the blocks of pilaster 95 using first and second pin holes 16 and 17 with the pins protruding into first and second pin holes 16 and 17 of the next lowermost block rather than the pin receiving cavities. Setback walls with incorporation of a sloping pilaster can also readily be achieved in a similar manner, with pins in first and second pin holes 16 and 17 of each pilaster block engaging pin receiving cavities 18 and 19 of the next lowermost block in the pilaster.

Blocks 1 are typically manufactured of concrete and cast in a high-speed masonry block or paver machine. The block is formed inverted to allow for forming of the pin receiving cavities 18 and 19. Pin receiving cavities 18 and 19, neck opening 13 and pin holes 16, 17, 19 and 30 are formed using cores. The pin holes extend through the depth of the block to enable the pin-hole forming cores to extend to the top face (which forms the bottom surface during casting). The pin receiving cavities extend only through a portion of the depth of the block to enable the pin receiving cavity forming cores to extend from the bottom face (which is the top surface during casting). Blocks 1 are formed as mirror image pairs joined at the front face 4 which are then subsequently split using a standard block splitter in the usual way to provide a rough front face 4 on the split blocks 1. Alternatively, other methods may be utilized to form a variety of front face surface appearances. Such methods are well known in the art.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block system for constructing a wall comprising:

a plurality of wall blocks, each wall block having parallel top and bottom faces, a front face, a rear face, and first and second side wall faces, a pin hole opening onto the top face, a pin receiving cavity opening onto the bottom face, wherein the pin receiving cavity opens onto the bottom face to a depth which is less than a distance between the top and bottom faces; and a plurality of pins, each pin having an upper section and a lower section, the upper section having a cross sectional dimension, the lower section having a cross sectional dimension, the cross sectional dimension of the upper section being greater than the cross sectional dimension of the lower section, the plurality of pins being sized such that the lower section is sized to be received in a pin hole in the top face of a wall block and the upper section is sized to be received in a pin receiving cavity in the bottom face of a wall block, the upper section further being sized to prevent the upper section from being received in a pin hole in the top face of a wall block.

2. The wall block system of claim 1 wherein each of the wall blocks has a plane of symmetry and wherein the pin receiving cavity has a rear wall extending generally perpendicularly to the plane of symmetry.

3. The wall block system of claim 2 wherein the pin receiving cavity has side walls generally non-parallel to the plane of symmetry.

4. The wall block system of claim 2 wherein the pin receiving cavity is equidistant to the plane of symmetry and to the side wall.

5. The wall block system of claim 1 wherein the pin hole comprises first and second pin holes, each pin hole opening onto the top face for receiving a lower section of a pin with the upper section of the pin protruding beyond the top face.

6. The wall block system of claim 1 wherein the side wall faces generally taper from the front face to the rear face.

7. The wall block system of claim 1 wherein the pin hole extends from the top face to the bottom face.

8. The wall block system of claim 1 wherein the pin receiving cavity comprises first and second pin receiving cavities.

9. The wall block system of claim 1 wherein the pin receiving cavity has a triangular shape.

10. The wall block system of claim 1 wherein the depth of the pin receiving cavity is 30 mm.

11. The wall block system of claim 1 wherein the pin receiving cavity is at a location with a distance to the front face that is less than a distance to the rear face.

12. The wall block system of claim 1 wherein the pin hole opens into the pin receiving cavity.

13. A wall block system for constructing a wall comprising:

a plurality of wall blocks, each wall block having parallel top and bottom faces, a front face, a rear face, and first and second side wall faces, a pin hole opening onto the top face, a pin receiving cavity opening onto the bottom face, wherein the pin hole comprises first and second pin holes, each pin hole opening onto the top face for receiving a lower section of a pin with the upper section of the pin protruding beyond the top face and wherein each wall block further comprises third and fourth pin holes, the third and fourth pin holes each opening onto the top face for receiving a lower section of a pin with the upper section of the pin protruding beyond the top face, the third and fourth pin holes being disposed forward of the first and second pin holes so as to provide a reduced or zero predetermined setback; and a plurality of pins, each pin having an upper section and a lower section, the upper section having a cross sectional dimension, the lower section having a cross sectional dimension, the cross sectional dimension of the upper section being greater than the cross sectional dimension of the lower section, the plurality of pins being sized such that the lower section is sized to be received in a pin hole in the top face of a wall block and the upper section is sized to be received in a pin receiving cavity in the bottom face of a wall block, the upper section further being sized to prevent the upper section from being received in a pin hole in the top face of a wall block.

14. The wall block system of claim 13 wherein each of the wall blocks has a plane of symmetry and wherein the pin receiving cavity has a rear wall extending generally perpendicularly to the plane of symmetry.

15. The wall block system of claim 14 wherein the pin receiving cavity has side walls generally non-parallel to the plane of symmetry.

16. The wall block system of claim 14 wherein the pin receiving cavity is equidistant to the plane of symmetry and to the side wall.

17. The wall block system of claim 13 wherein the side wall faces generally taper from the front face to the rear face.

18. The wall block system of claim 13 wherein the pin hole extends from the top face to the bottom face.

19. The wall block system of claim 13 wherein the pin receiving cavity opens onto the bottom surface to a depth which is less than a distance between the top and bottom surfaces.

20. The wall block system of claim 13 wherein the pin receiving cavity comprises first and second pin receiving cavities.

21. The wall block system of claim 13 wherein the pin receiving cavity has a triangular shape.

22. The wall block system of claim 13 wherein the depth of the pin receiving cavity is 30 mm.

23. The wall block system of claim 13 wherein the pin receiving cavity is at a location with a distance to the front face that is less than a distance to the rear face.

24. The wall block system of claim 13 wherein the pin hole opens into the pin receiving cavity.

* * * * *